United States Patent [19]

Wohler et al.

[11] 4,099,675

[45] Jul. 11, 1978

[54] SPRINKLER HEAD FOR WATER SPRAY COOLING INSTALLATIONS

[75] Inventors: Hans-Jöachim Wohler, Bochum-Dahlhausen; Walter Ilse, Bochum, both of Germany

[73] Assignee: Balcke-Durr AG, Ratingen, Germany

[21] Appl. No.: 708,630

[22] Filed: Jul. 26, 1976

[30] Foreign Application Priority Data

Jul. 24, 1975 [DE] Fed. Rep. of Germany ..... 2533021
Jun. 16, 1976 [DE] Fed. Rep. of Germany ..... 2626948

[51] Int. Cl.[2] ..... B05B 1/26
[52] U.S. Cl. ..... 239/498; 169/37; 239/500; 239/504; 261/111
[58] Field of Search ..... 239/498, 504, 524, 518, 239/500; 261/98, 111, DIG. 11; 169/37, 39

[56] References Cited

U.S. PATENT DOCUMENTS

| | | | |
|---|---|---|---|
| 2,092,674 | 9/1937 | Kennedy | 239/547 X |
| 2,391,616 | 12/1945 | Causer | 239/504 X |
| 3,160,212 | 12/1964 | Reid | 239/498 X |
| 3,568,875 | 9/1951 | Wethly et al. | 239/504 X |

*Primary Examiner*—Joseph F. Peters, Jr.
*Assistant Examiner*—Michael Mar
*Attorney, Agent, or Firm*—Joseph A. Geiger

[57] ABSTRACT

A sprinkler head for water spray cooling installations, attachable to a bottom wall of a hot water distribution conduit or distribution channel, the sprinkler head having a spray pipe reaching through an aperture of said bottom wall and a carrier shell or an open carrier cage surrounding the spray pipe and supporting one or several superposed cone-shaped spray plates at a short distance from the mouth of the spray pipe. Each spray plate has a pattern of spray distributor slots extending through its wall, so that a portion of the water passes through these slots and covers the central area underneath the sprinkler head, for an optimal distribution of the water.

18 Claims, 12 Drawing Figures

SPRINKLER HEAD FOR WATER SPRAY COOLING INSTALLATIONS

BACKGROUND OF THE INVENTION

1. Field of the Invention

The present invention relates to sprinkler-type water cooling installations, and, more particularly, to sprinkler heads for the distribution of hot water over cooling structures, for the direct transfer of heat from the water to a counter-flowing stream of air.

2. Description of the Prior Art

It is known to arrange sprinklers in water spray cooling installations for the distribution of hot water over the surfaces of cooling structures along which the water descends, while heat is transferred to an upwardly flowing stream of air. These sprinklers serve as water outlets of upwardly open distribution channels, or of closed distribution conduits, being arranged in a row at the underside of the channel or conduit. The water, under the influence of gravity, flows from the distribution channel or distribution conduit through the sprinkler heads, which divide the water flow into a diverging water spray. This water spray falls onto the surfaces of heat transfer structures which are arranged underneath the spray heads. As the water descends along the surfaces of the structures, a counterflowing air draft removes heat from the water through direct heat transfer and through evaporation of a portion of the water. For an optimal efficiency of heat transfer, it is important that the distribution of the water which is released through the sprinkler heads be as uniform as possible.

The known prior art sprinkler heads are so designed that the water is distributed over as large a circular area as possible. This is achieved with the aid of a flat splash plate at the bottom of the sprinkler head. The horizontal spacing between the sprinkler heads of this type is such that those surface portions of the cooling structures which lie underneath the solid splash plates of the sprinkler heads receive spray from adjacent sprinkler heads. This requirement, and the need for also covering those areas which are situtated underneath the concrete supporting trusses of the water distribution system, make it necessary for each sprinkler head to cover a very large area underneath it. This, in turn, necessitates a correspondingly great free-fall distance between the distribution channel and the splash plates of the sprinkler heads, for a greater speed of the impinging water.

One shortcoming of this prior art design is that the sprinkling pattern varies greatly with changes in the water level in the distribution system, as the latter affects the speed with which the water impacts on the splash plates.

SUMMARY OF THE INVENTION

It is a primary objective of the present invention to suggest an improved sprinkler head for water cooling installations of the type mentioned above, which produces a more uniform distribution of the hot water over the cooling structures underneath, by also covering the area which is situated directly underneath the sprinkler head. The novel sprinkler head is to be inexpensive and easy to manufacture and install. The spacing between adjacent sprinkler heads is to be such that only a small spray overlap is produced between sprinkler heads.

The present invention proposes to attain the above objectives by suggesting a sprinkler head with a spray plate in the shape of a cone, with spray slots extending through the wall of the cone. This conical spray plate produces a spray which covers a smaller area, thus no longer necessitating the great free-fall distance of the prior art sprinkler heads, meaning that the sprinkler plate can be arranged closely underneath the discharge mouth of the sprinkler head.

The novel sprinkler head design offers the advantage of distributing the water over the entire area of a circle surrounding the sprinkler head, including that central portion of the area which lies underneath the head. The reduced angle of spray divergence also makes it possible to mount the sprinkler heads closer to the supporting trusses of the concrete structure, while still assuring the coverage of the heat transfer structures which are situated underneath these trusses. The reduced angle of spray divergence has the advantage of producing substantially the same spray pattern under greater or lesser water flow rates through the system.

In a preferred embodiment of the invention, the conical spray plate is provided with a plurality of spray distributor slots extending inwardly from the circular periphery of the spray plate, in a converging, secantially oriented slot pattern. The preferred embodiment of the invention further suggests that these spray distributor slots be arranged in pairs of parallel slots of which one is longer than the other.

By way of an additional improvement of the invention, it is suggested that the sprinkler head be provided with at least two vertically superposed spray plates, so that at least two levels of spray are produced within a single spray cone. The lower spray plate, or plates, may be flat, or they may likewise have the shape of a distributor cone.

In the case of multiple spray plates, it is further suggested that the spray distributor slots of the superposed spray plates be angularly offset in relation to one another, in order to prevent the formation of strands of falling water underneath the distributor slots.

The invention further suggests that the secantially oriented spray distributor slots in the spray plates be so shaped that the slot width diminishes towards the periphery of the spray plate.

The preferred embodiment of the invention further suggests a sprinkler head in which the spray plate is attached to the bottom end of a tubular carrier shell which surrounds a downwardly extending spray pipe. The latter is preferably shaped in the manner of a spray nozzle, having a downwardly narrowing mouth portion. The attachment between the spray plate and the carrier shell may be of the peripheral type, with several — preferably three — plate supports extending from the periphery of the spray plate to the bottom end of the tubular part of the carrier shell, or the entire carrier shell may be longitudinally open in the manner of a cage, reaching around the underneath the spray plate, or spray plates, to support the latter from underneath by means of a central plate support.

The preferrd embodiment of the invention also suggests a most simple way of attaching the sprinkler heads to the distribution channel or distribution conduit, respectively. To this end, the spray pipe and the surrounding carrier shell have mating threads and cooperating clamping flanges engaging the flat bottom wall of the distribution conduit or distribution channel from opposite sides. The spray pipe, which is the inner one of the two parts, thereby reaches through an aperture in the channel wall, and its flange is located on the upper side of that wall. In its simplest version, the sprinkler head of the invention thus consists of two tubular parts which are assembled and mounted in place by simply threading one over the other. The result is nevertheless a firm, tight attachment of the sprinkler head to the bottom wall of the distributor channel.

The proposed tubular members of the sprinkler head are ideally suited for fabrication as injection-molded plastic parts, thus requiring no machining operations whatsoever. Being made entirely of plastic material, the sprinkler heads are thus safe from corrosion and buildup of deposits.

In a modified embodiment of the invention, the sprinkler head consists of three constituent parts, the spray plate being detachable from the plate-supporting outer sprinkler head member. The latter is in this case preferably shaped like a cage, with several vertical ribs reaching underneath the spray plate and forming a central bore into which a central stem of the spray plate, or spray plates, is insertable from above. This arrangement makes it possible to conveniently replace and exchange the spray plates against new ones or different ones, depending upon circumstances, without necessitating the removal of the sprinkler head itself.

BRIEF DESCRIPTION OF THE DRAWINGS

Further special features and advantages of the invention will become apparent from the description following below, when taken together with the accompanying drawings which illustrate, by way of example, several embodiments of the invention represented in the various figures as follows.

DESCRIPTION OF THE PREFERRED EMBODIMENTS

Figure 1:
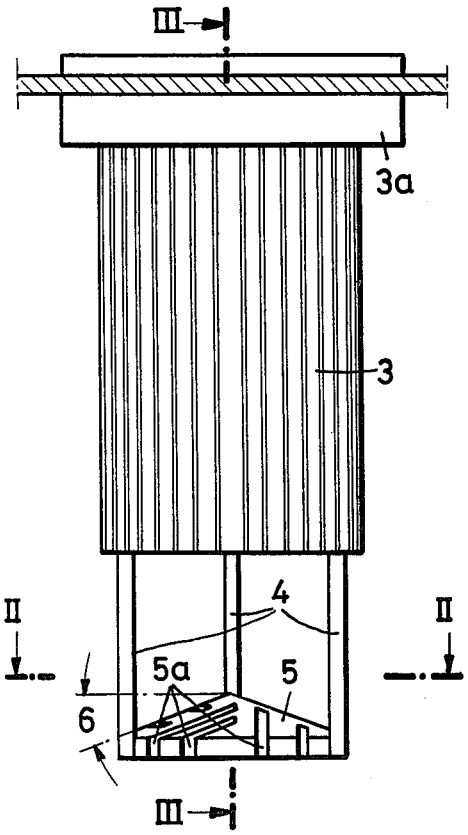
FIG. 1 is an elevational front view of a sprinkler head representing a first embodiment of the invention.
Figure 3:
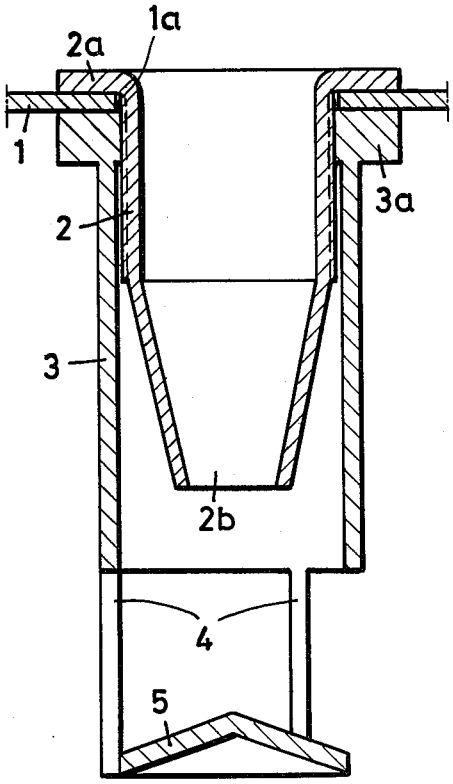
FIG. 3 shows the sprinkler head of FIG. 1 in a longitudinally cross-sectioned side view along line III—III of FIG. 1.
Figure 2:
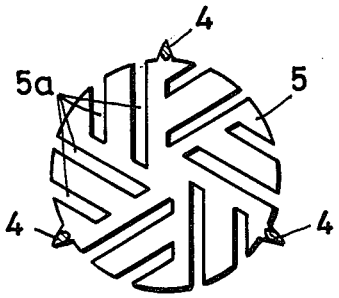
FIG. 2 is a transverse cross section through the sprinkler head of FIG. 1, along line II—II thereof.

Referring to FIGS. 1—3 of the drawings, there is illustrated a first embodiment of the novel sprinkler head of the invention, designed for use in conjunction with water spray cooling installations, where a plurality of sprinkler heads are mounted on the underside of a distributor tube or of a distributor channel, on a flat, substantially horizontal bottom wall 1. A circular aperture 1*a* in the bottom wall 1 serves for the emplacement and attachment of the sprinkler head.

As FIG. 3 indicates, the latter consists essentially of a central downwardly extending spray pipe 2 and of a cooperating diametrally larger carrier shell 3. Both the spray pipe 2 and the carrier shell 3 have enlarged flange portions on their upper extremities, the flange portion 2*a* of the spray pipe 2 engaging the wall 1 from the upper side, and the flange portion 3*a* of the carrier shell 3 engaging it from the lower side. Matching male and female threaded portions of the spray pipe 2 and of the carrier shell 3, respectively, provide a convenient mounting mode, in that the two parts can thus be clamped firmly and tightly against the wall portion surrounding the wall aperture 1*a*. For tightening purposes, either the flange portions 2*a* and 3*a* or/and the tubular portions of the spray pipe 2 and carrier shell 3 may be provided with suitable facets or other surface structures facilitating the application of tightening torque to the parts with a tool or by hand. The bottom portion of the spray pipe 2 is preferably provided with a converging taper in the form of a spray nozzle, forming a mouth portion 2*b*.

The carrier shell 3 has attached to its lower etremity a spray plate 5 in the shape of a shallow cone facing upwardly against the mouth portion 2*b* of the spray pipe 2. Between the periphery of the spray plate 5 and the tubular length portion of the carrier shell 3 extend three narrow vertical plate supports 4, thus holding the spray plate 5 against the impact of the falling water, while presenting a minimal obstruction to the lateral dispersion of the water, following its deflection on the conical surface of the spray plate 5. As FIG. 1 indicates at 6, the angle of inclination of the spray plate surface is preferably less than 30°.

In the spray plate itself, which has preferably a uniform wall thickness, are provided a number of spray distributor slots 5*a*, forming a special pattern which can be seen in FIG. 2. According to this slot pattern, all slots extend inwardly from the periphery of the spray plate 5, but not along radial lines towards the center of the plate, but along secants which, if extended, would pass at a distance from the center of plate 5. As the slot pattern further shows, the slots are preferably arranged in successive pairs of parallel slots of which one is longer than the other. In FIG. 2, for example, the slot pattern consists of six pairs of spray distributor slots 5*a*, meaning that adjacent pairs of slots form an angle of convergence of 60°.

In operation, a stream of water flows downwardly from the mouth portion 2*b* of the spray pipe 2 onto the conical spray plate 5 which is located a short distance below the mouth portion 2*b*. Upon reaching the spray plate 5, a portion of the water is deflected outwardly and downwardly in the direction of the surface inclination of the spray plate 5, while another portion of the water passes through its spray distributor slots 5*a*. The result is a spray pattern which covers not only an annular area surrounding the sprinkler head, but also the central area portion which is located directly underneath the spray plate 5 of the sprinkler head.

Figure 4:
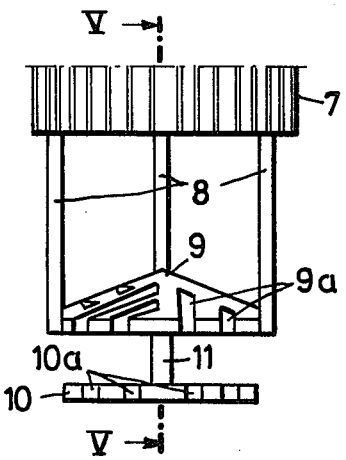
FIG. 4 shows, in an elevational view, the lower portion of a sprinkler head representing a second embodiment of the invention.
Figure 5:
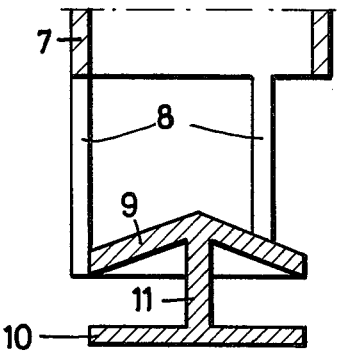
FIG. 5 shows the sprinkler head of FIG. 4 in a longitudinally cross-sectioned side view along line V—V of FIG. 4.
Figure 6:
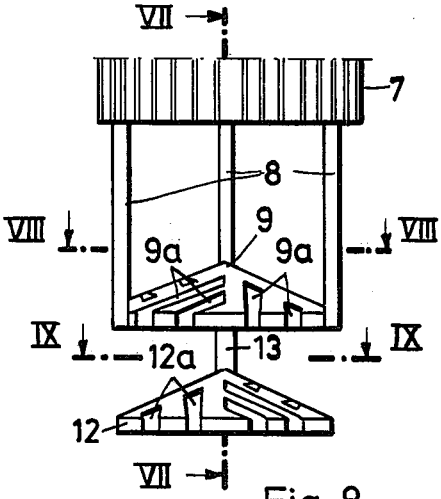
FIG. 6 shows a further modified sprinkler head, representing a third embodiment of the invention.
Figure 7:
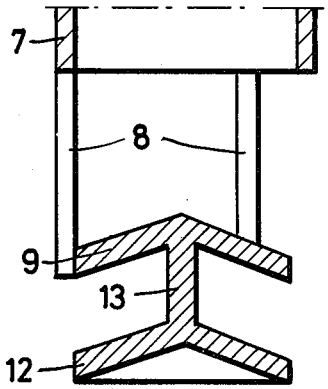
FIG. 7 is again a cross-sectional side view of the sprinkler head of FIG. 6 along line VII—VII thereof.

FIGS. 4 and 5 of the drawing show a second embodiment of the novel sprinkler head, and FIGS. 6 and 7 show a similar, third embodiment. These two embodiments differ from the earlier-described sprinkler head in that they have dual spray plates attached to the carrier shell 7. To the extent that the upper portion of the carrier shell 7 and the central spray pipe 2 are not shown in these figures, they are preferably unchanged from the corresponding parts of the embodiment of FIGS. 1–3. Referring to FIG. 4, for instance, it can be seen that an upper spray plate 9 is again carried by three peripherally arranged plate supports 8 which extend downwardly from the lower end of the tubular portion of the carrier shell 7. However, a distance underneath the spray plate 9 is arranged a lower spray plate 10, being connected to the plate 9 by means of a central intermediate support 11. While the impact surface of the upper spray plate 9 has again the shape of a shallow cone, the lower spray plate 10 is a flat disc.

Both spray plates are provided with a pattern of spray distributor slots 9*a* and 10*a*, respectively, in a pattern which is similar to the slot pattern described further above in connection with the first embodiment of the invention (FIG. 2). More will be said about the distributor slot patterns in connection with the embodiment of FIGS. 6 and 7.

Figure 8:
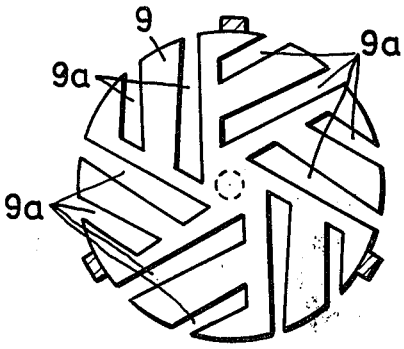
FIG. 8 is a transverse cross section through the sprinkler head of FIG. 6 along line VIII—VIII thereof.
Figure 9:
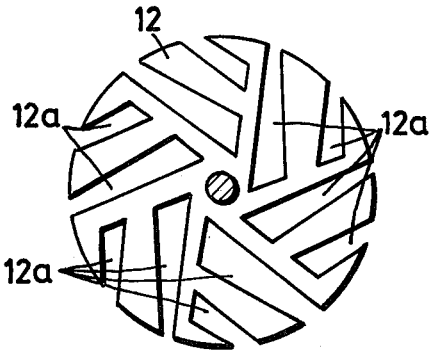
FIG. 9 is a similar transverse cross section through the sprinkler head of FIG. 6 along line IX—IX thereof.

The embodiment of FIGS. 6 and 7 differs from the embodiment of FIGS. 4 and 5 in that the lower spray plate 12 is not a flat disc, but shaped like the upper spray plate 9, while being connected thereto by a central intermediate support 13. The distributor slot patterns of the upper and lower spray plates are shown in FIG. 8 and FIG. 9 respectively. While the overall slot pattern of both spray plates resembles that of the spray plate 5 of FIG. 2, to the extent that the slots extend inwardly from the plate periphery in a secantial direction and are arranged in pairs of parallel slots, the width of the spray distributor slots 9*a* and 12*a* of the spray plates 9 and 12, respectively, is no longer uniform, but decreases towards the plate periphery. This means that more water can pass through the center regions of the spray plates, thus compensating somewhat for the outward deflection which is imparted to even those portions of the water stream which enter the spray distributor slots. In order to avoid the formation of water strands under vertical alignment of the slots of the upper spray plate 9 and of the lower spray plate 12, it is suggested that the slots of the two plates be angularly offset with respect to one another, or preferably, that the slot pattern of one spray plate be the mirror image of the slot pattern of the other plate. An example of this suggestion is illustrated in FIGS. 8 and 9 of the drawing.

In operation, the water flow exiting from the mouth portion 2*b* of the spray pipe 2 (FIG. 3) first impinges on the upper spray plate 9, which is located a short distance underneath the mouth portion 2*b* of the spray pipe 2, with the result that a portion of the water stream is deflected outwardly and downwardly along the conical surface of the spray plate 9, thereby forming a conical spray pattern. However, a sizable portion of the water stream is allowed to vertically flow through the spray distributor slots 9*a* of the upper spray plate 9, so that it falls onto the lower spray plate 12 —0 or on the lower spray plate 10 of the other embodiment — forming a second outwardly deflected spray pattern underneath the earlier-mentioned spray pattern, while the remaining portion of the water stream flows through the slots 12*a* of the lower spray plate 12. The sprinkler head with dual spray plates thus produces an excellent spray distribution by forming two concentric spray cones while allowing a portion of the water to cover the central area underneath the sprinkler head.

It should be understood that the novel sprinkler head of the present invention lends itself readily for further modifications, such as the addition of a third or fourth spray plate, the arrangement of superposed spray plates of different diameters and/or different angles of inclination, and/or different slot patterns in the individual spray plates. The proposed preferred embodiments of the invention, even when featuring multiple spray plates, have the great advantage of lending themselves for convenient manufacture from plastic materials, as finished injection-molded parts.

Figure 10:
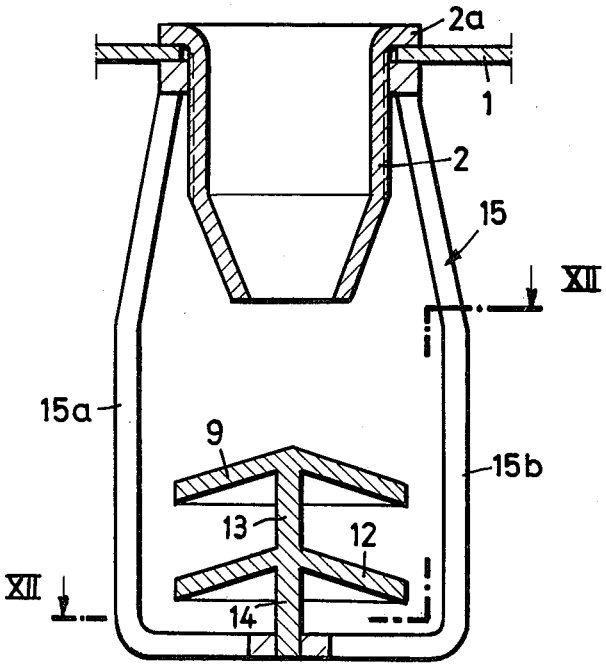
FIG. 10 shows a fourth embodiment of the invention in an elevational cross section.
Figure 12:
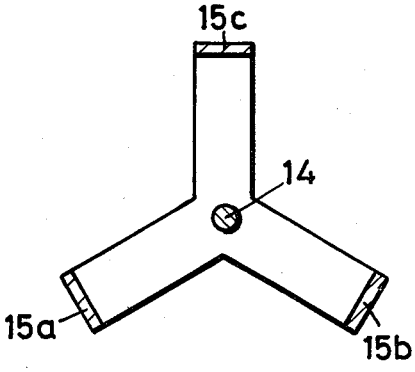
FIG. 12 is a transverse cross section along line XII—XII of either FIG. 10 or FIG. 11.
Figure 11:
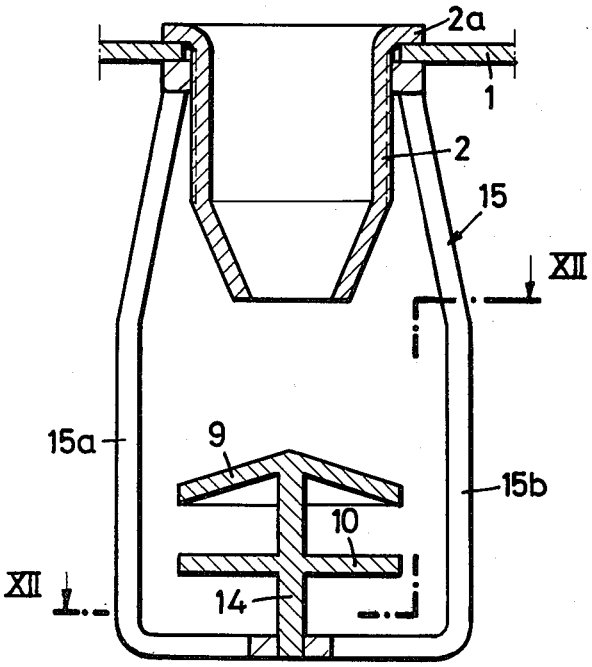
FIG. 11 shows a fifth embodiment of the invention in a similar representation.

Two additional embodiments of the invention are illustrated in FIGS. 10–12 of the drawings, where it can be seen that the sprinkler heads again feature an inner spray pipe 2 with an enlarged flange portion 2*a* extending downwardly through an aperture 1*a* of the distributor conduit or distributor channel, respectively. However, unlike in the previously described embodiments of the sprinkler head, the carrier shell is no longer a tubular body surrounding the spray pipe 2, but is shaped like a cage, in that three angularly spaced vertical ribs 15*a*, 15*b*, and 15*c* (FIG. 12) extend downwardly from a threaded annular flange portion 15*f* of the cage, so as to surround and reach underneath the spray plates 9 and 12 of FIG. 10, or the spray plates 9 and 10 of FIG. 11, respectively.

The embodiments of FIGS. 10 and 11 further differ from the previously described embodiments of the invention by featuring the dual spray plates as a removable component of the sprinkler head. This is accomplished by supporting the spray plates 9 and 10, or 9 and 12, respectively, on a central stem 14 which extends downwardly from the lower spray plate as an extension of the intermediate support 11 or 13, respectively, the stem 14 engaging a matching bore 15*d* in the center area of the bottom portion of the carrier cage 15. This arrangement has the particular advantage that it permits ready removal and replacement of the spray plates, as well as exchange of a particular type of spray plate for a different type of spray plate which produces a different spray pattern.

As with the previously described embodiments, the component parts of these two embodiments are again ideally suited for fabrication as injection-molded plastic parts. The open cage type outer member of the sprinkler head lends itself particularly well for the assembly operation, making it possible to engage the spray pipe 2 through the open spaces between the vertical ribs of the carrier cage 15.

It should be understood, of course, that the foregoing disclosure describes only preferred embodiments of the invention and that it is intended to cover all changes and modifications of these examples of the invention which fall within the scope of the appended claims.

We claim the following:

1. A sprinkler head particularly suited for water spray cooling installations, where hot water flows through horizontal water distribution conduits or water distribution channels and is to be sprayed onto heat transfer structures thereunder, as it exits through a plurality of sprinkler heads mounted on a bottom wall of said distribution conduit or distribution channel, the sprinkler head comprising in combination:

a downwardly oriented spray pipe attached to the bottom wall of the distribution conduit or distribution channel and communicating with the inside thereof to serve as an outlet, the spray pipe having a mouth portion at its lower extremity;

at least one spray plate arranged centrally underneath the mouth portion of the spray pipe, so as to face upwardly against the latter; and means for carrying and holding the spray plate in said position against the impact of an impinging stream of liquid exiting from the mouth portion of the spray pipe; and wherein the spray plate has an outwardly and downwardly sloping upper surface of which an impinging stream of liquid is deflected and spread into a generally cone-shaped divergent spray pattern; and the spray plate further has extending through it a plurality of apertures through which a portion of said liquid stream can pass downwardly so as to cover an area which is located centrally within said spray pattern, said apertures being spray distributor slots extending inwardly from the periphery of the spray plate, forming a slot pattern in which groups of parallel, secantially oriented slots follow each other in a regular angular succession, whereby the slots of angularly adjacent slot groups are oriented substantially transversely to each other and the inner extremities of one group of slots are spaced substantially the same distance from the nearest slot of the adjacent group of slots.

2. A sprinkler head as defined in claim 1, wherein the mouth portion of the spray pipe has a downwardly conically decreasing diameter, giving it the shape of a nozzle.

3. A sprinkler head as defined in claim 1, wherein the spray distributor slots of the spray plate have substantially vertical flanks; and at least some of the slots in the plate have a nonuniform width, the slot flanks diverging in the direction away from the plate periphery.

4. A sprinkler head as defined in claim 1, wherein a spray distributor slots of the spray plate form a slot pattern in which each group of slots comprises two spray distributor slots.

5. A sprinkler head as defined in claim 1, further comprising:

a second spray plate spaced a distance below and connected to the first-mentioned spray plate; and wherein both spray plates have a generally circular periphery;

the upper surface of the upper one of the two spray plates defines a shallow cone pointing towards the mouth portion of the spray pipe;

the lower one of the two spray plates has likewise extending through it a plurality of apertures through which liquid can pass downwardly; and the apertures of said lower spray plate are offset from the vertical projections of the apertures of said upper spray plate.

6. A sprinkler head as defined in claim 5, wherein the two spray plates are connected to each other by means of a central intermediate support.

7. A sprinkler head as defined in claim 5, wherein the upper surface of said lower spray plate is flat.

8. A sprinkler head as defined in claim 5, wherein the upper surface of said lower spray plate defines a shallow cone which points in the same direction as the cone of said upper spray plate.

9. A sprinkler head as defined in claim 5, wherein the spray distributor slots of the lower spray plate forms a slot pattern which is similar to that of the upper spray plate; and the secantial orientation of the slots in the upper plate is opposite to that of the slots in the lower plate, in relation to an intermediate radial orientation.

10. A sprinkler head as defined in claim 9, wherein the two spray plates are connected together by means of a central intermediate support and, with the latter, form integral portions of an injection-molded plastic part.

11. A sprinkler head as defined in claim 1, wherein the spray plate carrying means is a plate carrying member which is attached to the spray pipe and extends downwardly therefrom.

12. A sprinkler head as defined in claim 11, wherein the spray pipe has a tubular main length portion and an enlarged flange on its upper extremity;

the bottom wall of the distribution conduit or distribution channel has an opening which is larger than said tubular portion of the spray pipe, but smaller than its flange; and said flange engages the upper side of the bottom wall portion surrounding said opening.

13. A sprinkler head as defined in claim 12, wherein the plate carrying member surrounds at least a length portion of the spray pipe;

the plate carrying member and the spray pipe have cooperating male and female threads in said length portion; and the plate carrying member engages the lower side of the bottom wall portion surrounding said opening, thereby clamping it against the flange of the spray pipe.

14. A sprinkler head as defined in claim 11, wherein the plate carrying member has a tubular portion surrounding the spray pipe, and at least two rod-like spray plate supports extending downwardly from the lower end of said tubular portion to the periphery of the spray plate.

15. A sprinkler head as defined in claim 11, wherein the plate carrying member has the shape of a cage, including: a tubular upper end portion surrounding and engaging the spray pipe, thereby being attached to the latter, and a plurality of peripherally spaced rod-like spray plate supports extending downwardly from said upper end portion, on the outside of and to a point below the spray plate;

the spray plate supports are joined into a central hub underneath the spray plate; and the spray plate includes a downwardly extending central stem by which it is connected to the central hub of the cage-shaped plate carrying member.

16. A sprinkler head as defined in claim 15, wherein the connection between the central stem of the spray plate and said central hub is a releasable connection.

17. A sprinkler head as defined in claim 15, wherein the central stem of the spray plate carries, at a level intermediate the spray plate and the central hub, at least one additional spray plate, having likewise a plurality of apertures for the downward passage of liquid.

18. A sprinkler head as defined in claim 15, wherein the spray pipe, the cage-shaped carrying member, and the spray plate are separate injection-molded plastic parts.

* * * * *